US006397479B1

(12) United States Patent
Lüttgens

(10) Patent No.: US 6,397,479 B1
(45) Date of Patent: Jun. 4, 2002

(54) SHARPENER, IN PARTICULAR FOR SOFT-CORE PENCILS

(75) Inventor: Fritz Lüttgens, Erlangen (DE)

(73) Assignee: KUM Limited, Dublin (IE)

( * ) Notice: Subject to any disclaimer, the term of this patent is extended or adjusted under 35 U.S.C. 154(b) by 0 days.

(21) Appl. No.: 09/575,913

(22) Filed: May 23, 2000

(30) Foreign Application Priority Data

Jul. 23, 1999 (DE) ..... 199 34 691

(51) Int. Cl.[7] ..... B43L 23/00

(52) U.S. Cl. ..... 30/454; 30/457; 30/453; 144/28.11

(58) Field of Search ..... 30/452, 453, 454, 30/455, 456, 457, 462; 144/28.11, 28.2, 363, 360; 7/160; D19/73

(56) References Cited

U.S. PATENT DOCUMENTS 1,263,738 A * 4/1918 Boye ..... 30/452
4,248,283 A 2/1981 Kaye
5,167,071 A * 12/1992 Eisen ..... 30/452
5,845,406 A * 12/1998 Luttgens ..... 30/454
5,894,669 A * 4/1999 Luttgens ..... 30/452

FOREIGN PATENT DOCUMENTS

DE 37 37 863 C1 8/1988
DE 44 40 271 A1 5/1996
EP 0 872 356 A1 10/1998

* cited by examiner

*Primary Examiner*—Boyer Ashley
(74) *Attorney, Agent, or Firm*—Laurence A. Greenberg; Werner H. Stemer; Gregory L. Mayback

(57) ABSTRACT

A sharpener, in particular for soft-core pencils, includes a sharpener housing which carries a sharpener blade positioned tangentially in relation to a sharpener channel. The housing also has a free space that is open on a lower side of the housing. A core shaper can be introduced, preferably pivoted, from the lower side of the housing into the free space through a carrier plate which carries the core shaper and can be secured on the sharpener housing.

36 Claims, 4 Drawing Sheets

SHARPENER, IN PARTICULAR FOR SOFT-CORE PENCILS

BACKGROUND OF THE INVENTION

FIELD OF THE INVENTION

The invention relates to a sharpener, in particular for soft-core pencils, including a sharpener housing carrying a sharpener blade positioned tangentially at a sharpener channel, the housing having a free space laterally beneath a front end of a cutting edge of the sharpener blade, the free space being open on a lower side and/or on an upper side of the housing, the sharpener channel opening out into the free space, and a core shaper to be introduced into the free space for shaping a core tip.

A sharpener which is known, for example, from European Patent Application 0 827 844 A1 has a guide channel in a sharpener housing. The sharpener housing is usually injection molded in one piece from plastic. The guide channel tapers conically in the direction of introduction and is intended for a front end of a pencil which is to be sharpened. Moreover, the sharpener housing has a free space into which a guide channel, that receives the pencil or core tip, opens out. A sharpener blade which is retained on the sharpener housing is, in turn, positioned tangentially in relation to the guide channel.

In the case of that known sharpener, a shaping blade which projects into the free space and has a cutting edge or shaving edge with a web-like structure for the purpose of shaping the core tip, is integrally formed on the sharpener housing. However, it is known from European Patent Application 0 872 356 A1 to provide such a shaping blade on a cleaning stick which is retained in a captive, but removable, manner on the sharpener housing. German Published, Non-Prosecuted Patent Application DE 44 40 271 A1 discloses an embodiment of a sharpener for soft-core pencils having an adjustable shaping blade which can be displaced on a fastening element transversely to the sharpener blade, and thus transversely to the longitudinal axis of the sharpener channel.

Through the use of such sharpeners having core shapers in the form of a shaping blade which can be introduced into the active region of the sharpener in addition to the sharpener blade, the pencil or core tip of a pencil introduced into the sharpener channel may be shaped either in a relatively sharp and pointed manner or in a rounded manner. During sharpening, i.e. during rotation of the pencil guided in the guide or sharpener channel, the sharpener blade assumes the task of shaping the conical pencil tip and thus if appropriate, at the same time, of shaving the pencil material enclosing the same. Through the use of such sharpeners, usually so-called soft or soft-core pencils, in particular cosmetics pencils, are sharpened and additionally shaped at their core tip. That allows both soft cores which are encased in a shavable material, e.g. wood or plastic, and soft cores alone, as are common predominantly as make-up or cosmetics pencils, to be sharpened.

The sharpener known from German Published, Non-Prosecuted Patent Application DE 44 40 271 A1 involves a high outlay to produce and, in addition, the regularly necessary task of cleaning the sharpener in the vicinity of the core shaper from accumulating core substance which tends to smear is made particularly difficult. However, it is the case with the sharpener known from European Patent Application 0 872 356 A1 that the handling of the cleaning stick with the shaving tongue, projecting laterally therefrom, as a core shaper, is frequently considered laborious.

SUMMARY OF THE INVENTION

It is accordingly an object of the invention to provide a sharpener, in particular for soft-core pencils, which overcomes the hereinafore-mentioned disadvantages of the heretofore-known devices of this general type and in which, along with straightforward cleaning and removal of a sticky soft-core substance, straightforward introduction of a core shaper into a free space of the sharpener, with simultaneous avoidance of damage to the core shaper, is made possible.

With the foregoing and other objects in view there is, provided, in accordance with the invention, a sharpener, in particular for a soft-core pencil, comprising a sharpener blade having a cutting edge with a front end; a sharpener housing having a lower side, an upper side, a free space and a sharpener channel opening into the free space, the free space being open at least at one of the sides, the free space disposed laterally beneath the front end of the cutting edge of the sharpener blade, and the sharpener housing carrying the sharpener blade tangentially to the sharpener channel; a core shaper to be introduced into the free space for shaping a core tip; and a carrier plate to be secured on the sharpener housing, the carrier plate carrying the core shaper for introducing the core shaper into the free space from one of the sides.

In accordance with another feature of the invention, the carrier plate has a container-like structure or shape. For this purpose, it has an at least partially continuous container wall.

On one hand, introducing the core shaper into the free space of the sharpener housing or body through the use of the carrier plate from the upper side or lower side of the housing ensures straightforward handling of the sharpener in its function as a core shaper, in particular for soft-core pencils. On the other hand, likewise straightforward handling makes it possible for the core shaper, when raised off from the sharpener housing, to be cleaned outside the sharpener housing since it is precisely in the region of the core shaper that the pasty and sticky core substance which has been cut or shaved off from the core tip accumulates.

The carrier plate, which retains the core shaper, may be pushed into, or positioned on, the lower side or upper side of the sharpener housing and connected releasably to the sharpener housing, for example, through the use of latching hooks or similar form-locking elements. A form-locking connection is one which connects two elements together due to the shape of the elements themselves, as opposed to a force-locking connection, which locks the elements together by force external to the elements. With the carrier plate constructed as a displaceable base plate, the rear side of the sharpener housing, which is the side directed away from the introduction opening that opens out into the sharpener channel, is expediently recessed in the region of the free space in such a way that the core shaper, which projects up from the carrier plate, can be introduced into the free space through the recess.

In accordance with a further feature of the invention, the carrier plate is retained in a pivotable manner on the sharpener housing, for which purpose the latter is connected to the carrier plate preferably through a film hinge. In this case, the film hinge is expediently integrally formed on the rear wall of the sharpener body or housing, preferably in the region of the bottom edge of the housing, and the rear wall bounds the rear side of the free space. In this case, the carrier plate advantageously has a peripheral side wall, and the film hinge is accordingly integrally formed on the side wall corresponding to the rear wall of the sharpener housing. The carrier plate with the side walls thus forms a half-shell. In this case, the clear width between mutually opposite side walls of the carrier plate is adapted to the outer dimensions of the sharpener housing in such a way that, when the core shaper is pivoted into the free space through the use of the carrier plate, the side walls of the latter engage in a form-locking manner around the lower side of the sharpener housing. As a result, the carrier plate is retained in a releasable, but captive, manner on the sharpener housing. The shell-like carrier plate thus serves, at the same time, as a shaving-collecting chamber for the shavings produced during the core-shaping operation.

In accordance with an added feature of the invention, it is possible to position a shaving-collecting container on the sharpener housing. The shaving-collecting container is expediently likewise in the form of a shell and has a peripheral side wall which, in turn, is adapted to the outer dimensions of the upper side of the sharpener housing in such a way that the shaving-collecting container, in turn, engages in a form-locking manner around the upper side of the sharpener housing. It is thus also possible, in principle, for the core shaper to be introduced, preferably once again pivoted, into the free space through the use of the shaving-collecting container, which in this case acts as a carrier plate, from the upper side of the housing.

In accordance with an additional feature of the invention, the carrier plate, which again preferably has a shell-like structure, is connected to the shaving-collecting container, likewise having a shell-like structure, through a film hinge. In this case, the film hinge is, in turn, integrally formed on the side walls, directed toward the core shaper, of the carrier plate, on one hand, and of the shaving-collecting container, on the other hand. This forms an integral shaving-collecting housing which is formed from two housing halves, into which the sharpener housing can be inserted by being positioned on the carrier plate and can be closed off on the upper side through the use of the shaving-collecting container. It is likewise possible first of all for the shell-like shaving-collecting container to be positioned on the upper side of the sharpener housing, with the result that the sharpener housing is retained in a captive manner thereon. Then, for the core-shaping operation, the carrier plate can be pivoted against the sharpener housing from the lower side of the same, and secured thereon, while the core shaper penetrates into the free space of the sharpener housing. In this case, the carrier plate closes off the lower side of the sharpener housing, which is open at the bottom, preferably to the full extent, but at least in the region of the free space.

A closed sharpener system is provided overall both with the sharpener constructed with the shaving-collecting container integrally formed pivotably on its sharpener body, and the carrier plate likewise integrally formed pivotably thereon, and with the two-shell housing structure formed by the shaving-collecting container and the preferably container-like carrier plate. This advantageously allows separate emptying of the shavings cut off through the use of the sharpener blade, on one hand, and of the comparatively sticky or tacky core shavings cut off or shaved off through the use of the core shaper, on the other hand. This occurs in such a way that the sharpener system is opened either on the upper side or on the lower side of the housing, while the respectively other side of the housing remains closed off. The respective shaving waste can thus be easily disposed of separately since it is not mixed with the other shaving waste during emptying and cleaning of the sharpener.

In accordance with yet another feature of the invention, the carrier plate and/or the shaving-collecting container is preferably formed of a transparent, i.e. translucent plastic. This means that, with the sharpener housing covered or closed on both sides through the use of the carrier plate, on one hand, and the shaving-collecting container, on the other hand, the filling level of the shavings can be seen from the outside. As a result, the shaving-collecting housing can be emptied before a build-up of shavings can occur in the region of the sharpener blade or of the core shaper.

In accordance with yet a further feature of the invention, the core shaper, which projects out of the carrier plate, is rounded on its rear side that is directed away from its shaving rib or edge so that a guide edge or retaining edge is formed, in such a way that, when the core shaper is pivoted into the free space, the carrier plate is positioned in a first position or clamping position. In this position, the carrier plate is already retained on the sharpener housing, while the core shaper is still inactive. In this position, the shaving rib or shaving edge of the core shaper is not yet in the active region of the sharpener channel, which is continued into the free space. If the carrier plate is then pivoted further in the direction of the sharpener blade and is joined in a captive manner to the sharpener housing, the core shaper is in its active end position. Upon rotation of a soft-core or cosmetics pencil introduced into the sharpener channel, the core tip of the pencil is then rounded as intended in that the core tip is guided along the shaving rib of the core shaper and is thus shaped by a shaving action.

In accordance with yet a concomitant feature of the invention, the core shaper itself is formed by a wedge-shaped shaving contour which is provided in a supporting protrusion or a supporting surface. The supporting surface is integrally formed on at least one supporting side, which projects out of the carrier plate in the direction of the sharpener blade, and runs transversely to the side. There are preferably provided two mutually opposite supporting sides, which are connected in a web-like manner to one another through the supporting surface.

Other features which are considered as characteristic for the invention are set forth in the appended claims.

Although the invention is illustrated and described herein as embodied in a sharpener, in particular for soft-core pencils, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 6 is a perspective view of the closed sharpener according to FIG. 1 or 2 with the shaving-collecting container placed in position and the carrier plate pivoted in;

FIG. 8 is perspective, sectional view of the embodiment of the sharpener according to FIG. 7 with the carrier plate pivoted in.

DESCRIPTION OF THE PREFERRED EMBODIMENTS

Figure 1:
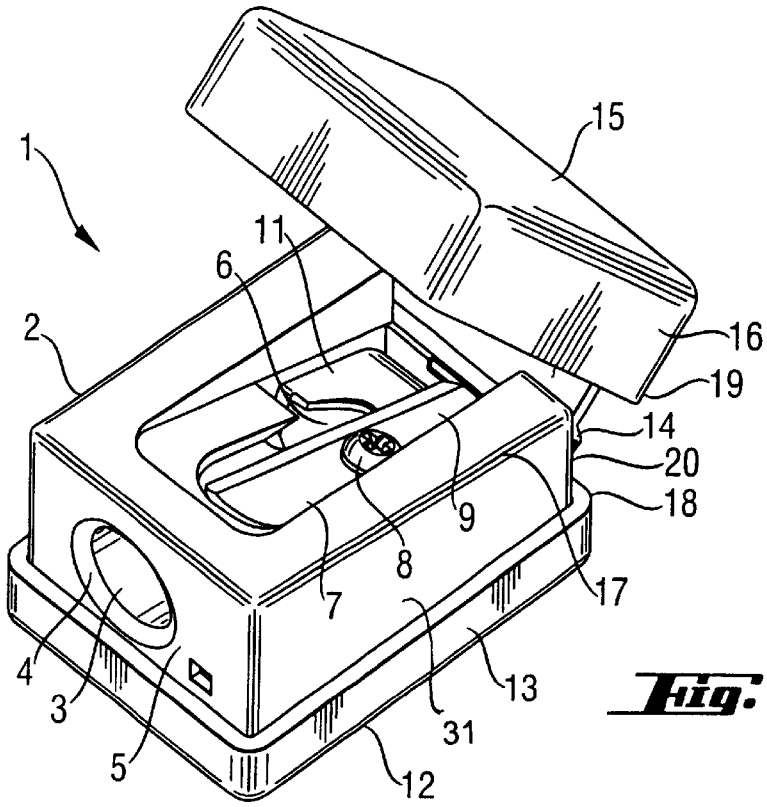
FIG. 1 is a diagrammatic, perspective view of a first embodiment of a sharpener with a sharpener housing positioned on a carrier plate and a shaving-collecting container pivoted into an open position.
Figure 2:
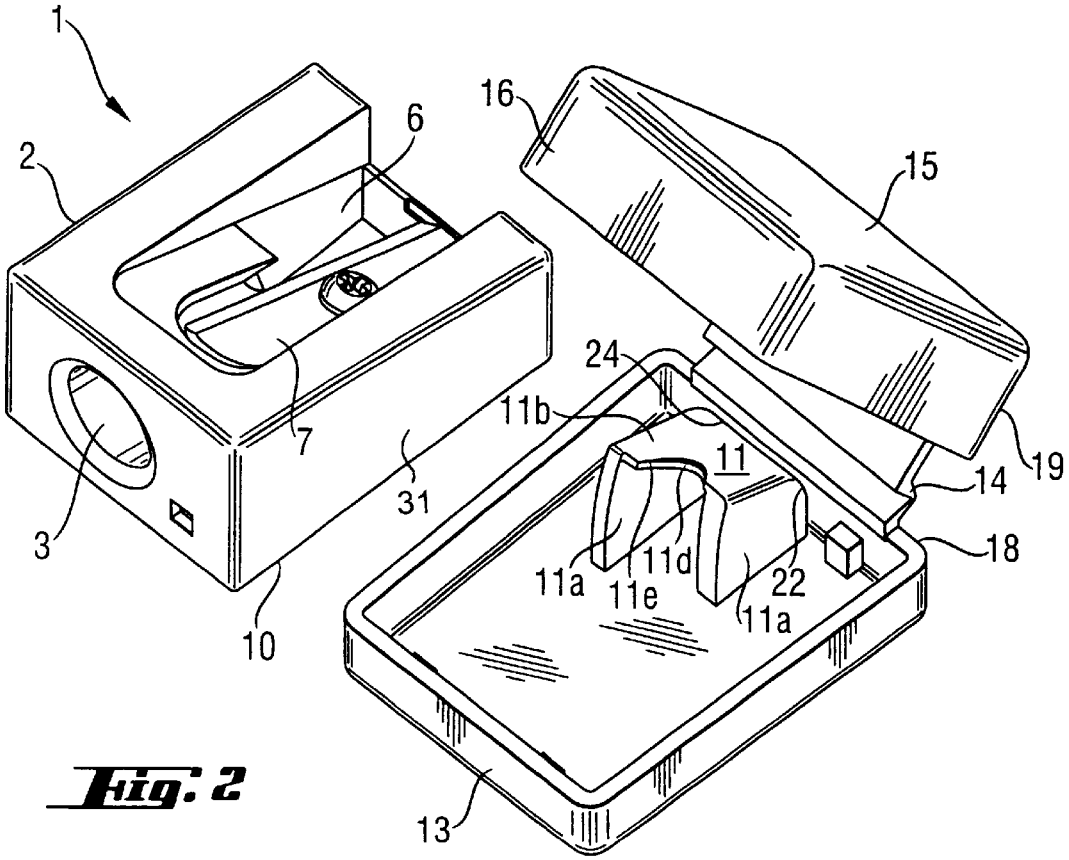
FIG. 2 is an exploded perspective view of the formed carrier plate with a core shaper retained thereby, with the shaving-collecting container articulated thereon as an integral housing and with a sharpener body removed and located beside the same.

Referring now in detail to the figures of the drawings, in which parts corresponding to one another are provided with the same designations, there is seen a sharpener 1 that has a sharpener housing or a sharpener body 2 which is preferably produced from plastic by injection molding. The sharpener housing 2 includes an expediently conical sharpener channel 3 best seen in FIGS. 3 and 4 and a right side 30 and left side 31. The sharpener channel 3 has an end which is located opposite an introduction opening 4 in a front or end side 5. That end of the sharpener channel 3 opens out into a free space 6 best seen in FIG. 2. A sharpener blade 7 which is positioned tangentially in relation to the sharpener channel 3 is secured on the sharpener housing 2 through the use of a screw 8. The sharpener blade 7 has a cutting edge with a front end 9 projecting beyond the sharpener channel 3 and the sharpener blade 7 partially covers the free space 6.

Figure 3:
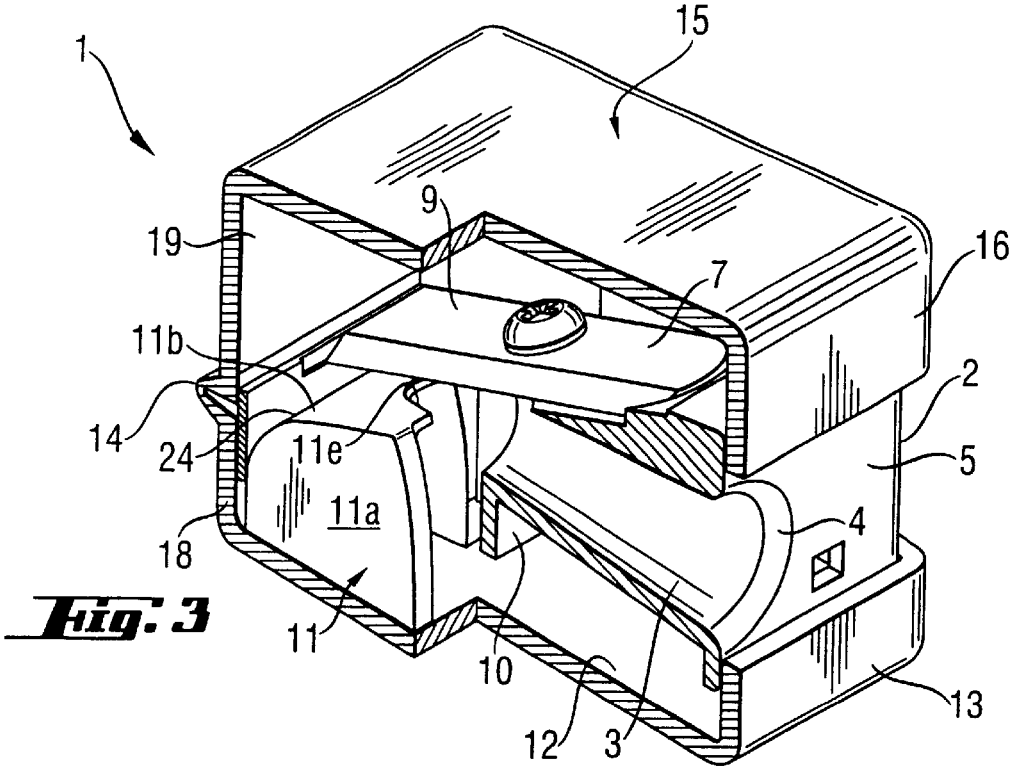
FIG. 3 is a perspective, sectional view of the sharpener according to FIG. 1.
Figure 4:
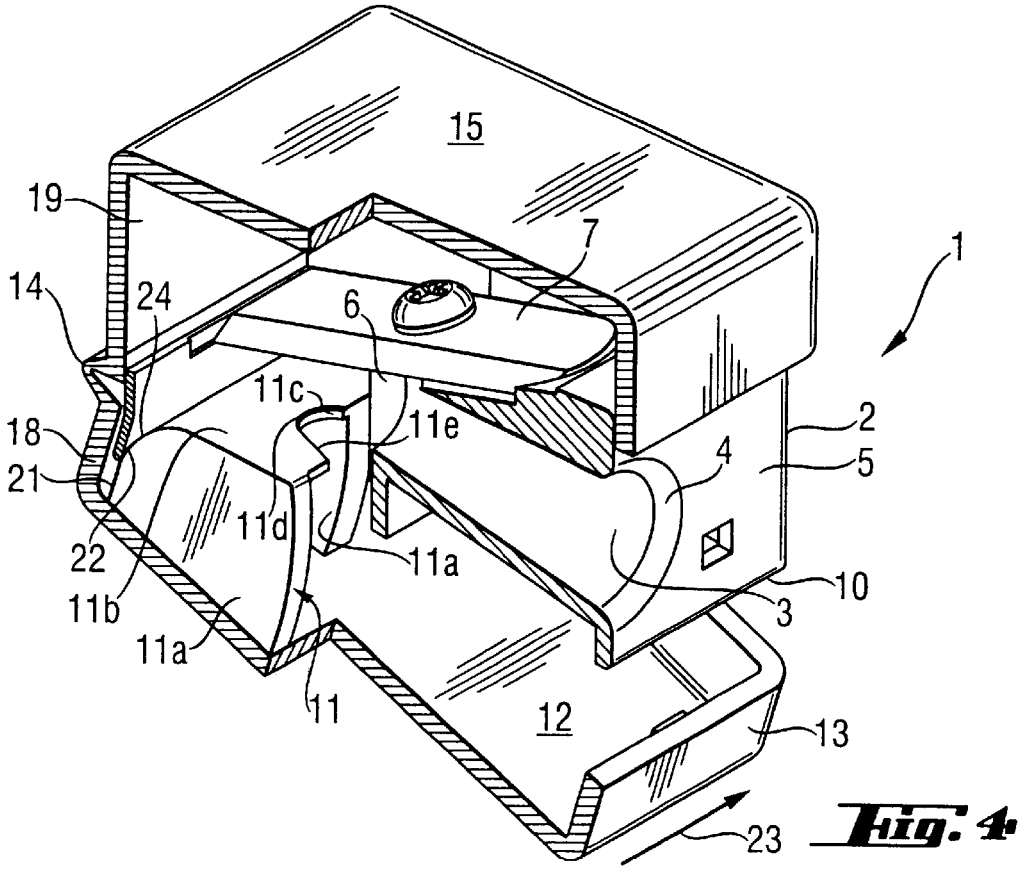
FIG. 4 is a perspective, sectional view of the sharpener according to FIG. 1 with the carrier plate retained in a first pivot position.

It is possible to introduce a core shaper 11 into the free space 6. The core shaper 11 is open in the downward direction on an underside or lower side 10 of the sharpener housing or body 2 and is retained on a carrier plate 12, as is best seen in FIGS. 3 and 4. The core shaper 11 is preferably pivoted into the free space 6 from the lower side 10 of the housing, as can be seen comparatively clearly from FIGS. 3 to 5 and from FIG. 7.

In the preferred embodiment according to FIGS. 1 to 4, the carrier plate 12 has a peripheral container wall or side wall 13, preferably on all sides, as a result of which the carrier plate 12 forms a housing shell. A film hinge 14 connects the housing shell to a top housing shell 15, which constitutes a shaving-collecting container. The shaving-collecting container 15, which in turn has a preferably continuous peripheral container wall or side wall 16, can be positioned on a top side or upper side 17 of the sharpener housing or sharpener body 2 and retained thereon in a form-locking manner. For this purpose, a clear width between mutually opposite sides of the side wall 16 is adapted to outer dimensions of the upper side 17 of the sharpener housing 2. Accordingly, the distance between the sides of the side wall 13 of the shell-like carrier plate 12 is adapted to the outer dimensions of the lower side 10 of the sharpener housing 2. The film hinge 14 is expediently formed integrally on or in one piece with an end or rear side 18 of the side wall 13 of the carrier plate 12. The end or rear side 18 is located nearest the core shaper 11. The film hinge 14 is also integral or in one piece with a corresponding end or rear side 19 of the shaving-collecting container 15, as is seen in FIGS. 3 and 4.

This preferred embodiment of the sharpener 1 is used as intended by retaining the integral housing on the sharpener body by virtue of the shaving-collecting container 15 being positioned on the upper side 17 of the sharpener housing 2. The integral housing is formed by the carrier plate 12 with the core shaper 11 and the shaving-collecting container 15 articulated thereon through the film hinge 14. As can be seen from FIG. 4, the carrier plate 12 with the core shaper 11 is then pivoted away wholly or partially from the sharpener body 2.

FIG. 4 shows the carrier plate 12 in a first retaining or clamping position, in which the core shaper 11 is not yet located in the active region of the sharpener 1. This first retaining position or clamping position of the carrier plate 12 is achieved by a specific shaping of the core shaper 11 on its rear side 21. The rear side 21 is directed toward the rear end side 18 of the shell-like carrier plate 12 and thus toward a rear wall 20 of the sharpener housing 2. For this purpose, side walls or supporting sides 11*a*, which project up at least more or less vertically from the carrier plate 12, are provided with an arcuate rounding 22 in the vicinity or region of the rear side 21 of the core shaper 11. The rounding 22 runs along a supporting surface 11*b* which runs transversely to the supporting sides 11*a* and at a distance from the carrier plate 12 and extends in a web-like manner between the supporting sides 11*a*. As a result, a guide edge 24 running in a transverse direction 23 of the carrier plate 12 is formed there. The active side of the core shaper 11 is located opposite the guide edge or curve 24. A wedge-shaped shaping contour 11*c* with a rounded wedge tip 11*d* is introduced into the supporting plate or supporting surface 11*b* of the core shaper 11 on the active side of the core shaper 11. The supporting plate or supporting surface 11*b* is formed integrally on or in one piece with the supporting sides 11*a*. The shaving contour 11*c* forms a shaving edge or shaving rib 11*e*. When the core shaper 11 is pivoted into the free space 6, the shaving edge or shaving rib lie butts tangentially against the sharpener channel 3, which is continued into the free space 6. This can be seen comparatively clearly from FIG. 3. The shaving edge 11*e* of the core shaper 11 serves for rounding a core tip of a non-illustrated soft-core or cosmetics pencil introduced into the sharpener channel 3 through the introduction opening 4.

Figure 5:
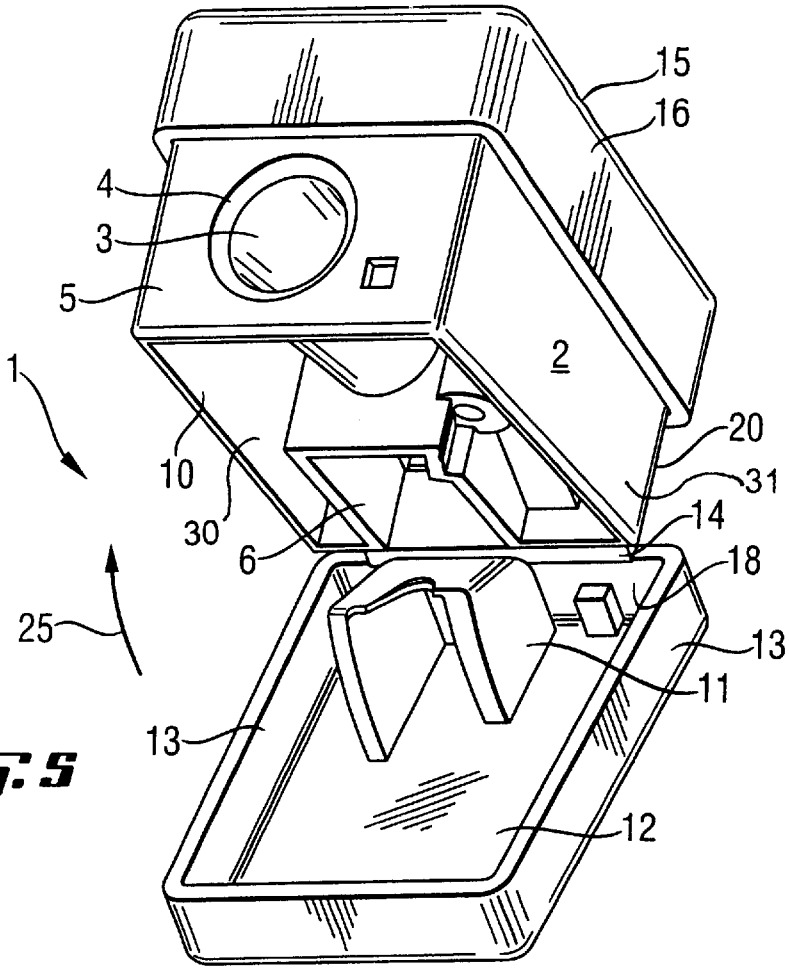
FIG. 5 is a front-perspective view of a second embodiment of the sharpener with the carrier plate retained on the sharpener body in a pivoted-away position.
Figure 6:
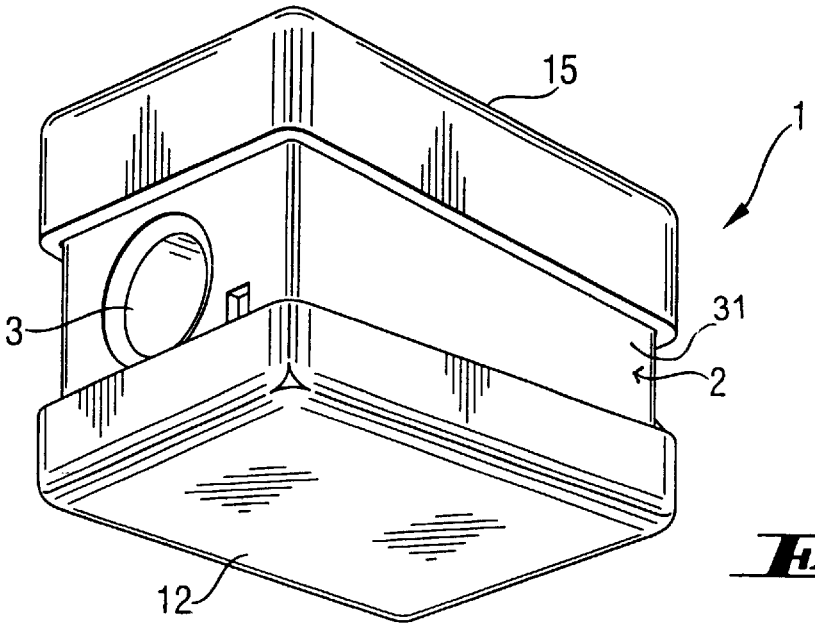

FIG. 5 shows an alternative structure of the sharpener 1 with a separate shaving-collecting container 15, which is positioned in a form-locking manner on the upper side 17 of the sharpener housing 2. In this embodiment, the carrier plate 12, which once again has a shell-like structure, is articulated on the housing in the region of the lower side 10 of the sharpener housing 2. The carrier plate 12 is once again articulated through the use of a film hinge 14. It is also the case in this embodiment that the film hinge 14 is formed integrally or in one piece preferably on the rear side 18 of the shell-like carrier plate 12 and on the corresponding rear wall 20 of the sharpener housing 2. In this case, the position and the configuration of the core shaper 11 correspond to the configuration and functioning of the core shaper 11 of the embodiment according to FIGS. 1 to 4.

Figure 7:
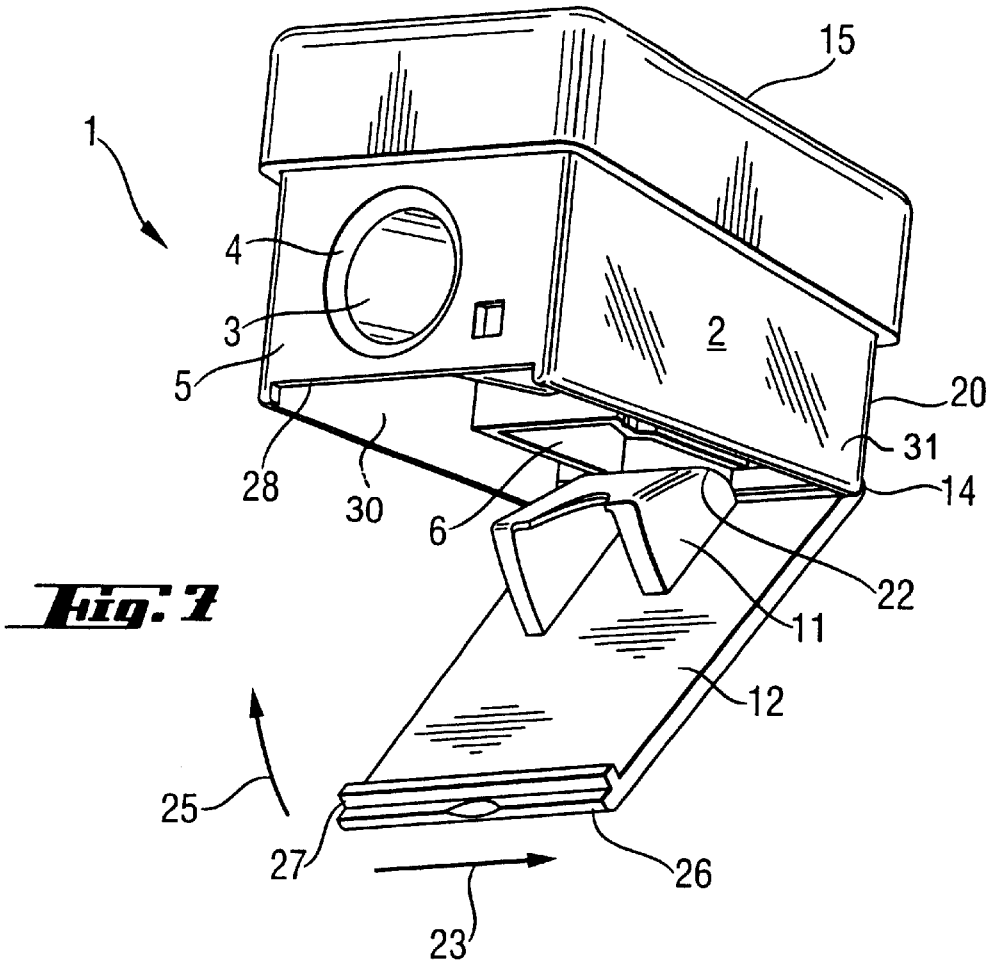
FIG. 7 is respective view, similar to FIG. 5, of a third embodiment of the sharpener with the carrier plate pivoted away.
Figure 8:
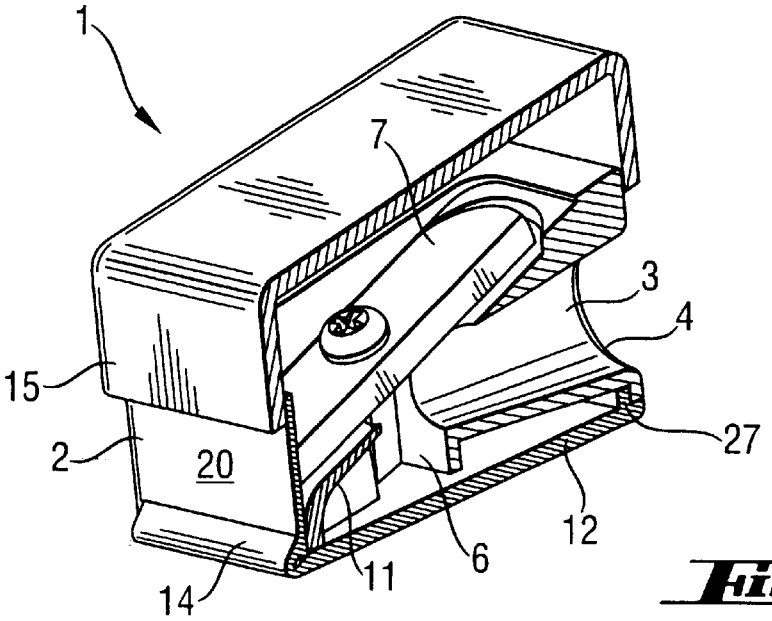

A further embodiment of the sharpener 1 with a core shaper 11 which can be pivoted into the free space 6 in the pivoting direction 25 is shown in FIGS. 7 and 8. In this embodiment, once again, the shaving-collecting container 15 is positioned as a separate shell-like housing part on the upper side 17 of the sharpener housing or sharpener body 2. In contrast to the embodiments according to FIGS. 1 to 6, the carrier plate 12 is constructed as a base plate without a peripheral side wall. However, it is also the case in this embodiment that the carrier plate 12 is articulated, once again, on the rear wall 20 of the sharpener body 2 through a film hinge 14. An actuating or handling side 26 is located opposite the pivot connection. A slightly set-back transverse web 27 which runs preferably over the entire width of the carrier plate 12 is formed integrally on or in one piece with the carrier plate 12 on the actuating or handling side 26. With the carrier plate 12 pivoted in and the core shaper 11 located in the free space 6, the transverse web engages in a form-locking manner in a corresponding transverse groove 28 on the end side 5 of the sharpener body 2, on the lower side 10 of the latter, as can be seen from FIG. 8.

The shaving-collecting container 15 and the carrier plate 12 preferably are formed of transparent plastic. The core shaper 11, which advantageously likewise is formed of plastic, may be formed integrally on or in one piece with the carrier plate 12 or welded or adhesively bonded thereto. However, the core shaper 11 is preferably connected releasably to the expediently container-like carrier plate 12. This allows better and quicker cleaning of the core shaper 11 and/or of the carrier plate 12.

I claim:

1. A sharpener comprising:

a sharpener blade having a cutting edge with a front end;

a sharpener housing having a lower side, an upper side, a free space and a sharpener channel opening out into said free space at a given location, said free space being open at least at one of said sides, said free space disposed laterally beneath said front end of said cutting edge of said sharpener blade, and said sharpener housing having a rear wall directed away from said given location and carrying said sharpener blade tangentially to said sharpener channel;

a core shaper in said free space for shaping a core tip;

a carrier plate secured and pivotally retained on said sharpener housing, said carrier plate carrying said core shaper for introducing said core shaper into said free space from one of said sides; and a film hinge retaining said carrier plate on said rear wall of said sharpener housing.

2. The sharpener according to claim 1, wherein said carrier plate has an at least partially peripheral container wall.

3. The sharpener according to claim 1, wherein said carrier plate at least partially closes off said lower side of said sharpener housing.

4. The sharpener according to claim 1, wherein said core shaper projects out of said carrier plate, has a shaving rib, and has a rounded rear side directed away from said shaving rib to form a guide edge retaining said carrier plate in a clamping position when said core shaper is pivoted into said free apace.

5. The sharpener according to claim 1, wherein said core shaper has at least one supporting side projecting out of said carrier plate, a supporting surface running transversely to said at least one supporting side and integrally formed on said at least one supporting side, and a wedge-shaped shaving contour integrally formed on said supporting surface.

6. The sharpener according to claim 1, wherein said core shaper projects out of said carrier plate, has a shaving rib, and has a rounded rear side directed away from said shaving rib to form a guide edge retaining said carrier plate in a clamping position when said core shaper is pivoted into said free space, said core shaper has at least one supporting side projecting out of said carrier plate, a supporting surface running transversely to said at least one supporting side and integrally formed on said at least one supporting side, and a wedge-shaped shaving contour integrally formed on said supporting surface, and said guide edge is disposed on said at least one supporting side and extends over said supporting surface,.

7. The sharpener according to claim 1, wherein said carrier plate has a peripheral side wall for form-lockingly positioning said carrier plate on said lower side of said sharpener housing.

8. The sharpener according to claim 1, wherein said core shaper is releasably connected to said carrier plate.

9. The sharpener according to claim 1, wherein said sharpener housing has:

a left side connected to said carrier plate; and an right side connected to said carrier plate.

10. The sharpener according to claim 1, wherein said carrier plate connects to said lower side of said sharpening housing.

11. The sharpener according to claim 10, wherein said carrier plate closes said lower side of said sharpening housing.

12. The sharpener according to claim 1, wherein said carrier plate connects to said upper side of said sharpening housing.

13. The sharpener according to claim 12, wherein said carrier plate closes said upper side of said sharpening housing.

14. The sharpener according to claim 1, including a shaving-collecting container to be positioned on said sharpener housing from said upper side of said sharpener housing, said carrier plate pivotally retained on said shaving-collecting container.

15. The sharpener according to claim 14, wherein at least one of said shaving-collecting container and said carrier plate are formed of transparent plastic.

16. The sharpener according to claim 14, wherein said shaving-collecting container has a peripheral side wall for form-lockingly positioning said shaving-collecting container on said upper side of said sharpener housing.

17. The sharpener according to claim 14, wherein said shaving-collecting container and said carrier plate form a double-shell integral housing for receiving said sharpener housing and form-lockingly and releasably connecting said sharpener housing to at least one of said shaving-collecting container and said carrier plate, and said integral housing is retained on said sharpener housing by said carrier plate when said shaving-collecting container has been pivoted away.

18. The sharpener according to claim 14, wherein said shaving-collecting container and said carrier plate form a double-shell integral housing for receiving said sharpener housing and form-lockingly and releasably connecting said sharpener housing to at least one of said shaving-collecting container and said carrier plate, and said integral housing is retained by said shaving-collecting container when said carrier plate has been pivoted away.

19. A sharpener, comprising:

a sharpener blade having a cutting edge with a front end;

a sharpener housing having a lower side, an upper side, a free space and a sharpener channel opening into said free space, said free space being open at least at one of said sides, said free space disposed laterally beneath said front end of said cutting edge of said sharpener blade, and said sharpener housing carrying said sharpener blade tangentially to said sharpener channel;

a core shaper in said free space for shaping a core tip;

a carrier plate secured on said sharpener housing, said carrier plate carrying said core shaper for introducing said core shaper into said free space from one of said sides;

a shaving-collecting container to be positioned on said sharpener housing from said upper side of said sharpener housing, said carrier plate pivotally retained on said shaving-collecting container; and a film hinge connecting said carrier plate and said shaving-collecting container to one another.

20. The sharpener according to claim 19, wherein said carrier plate has an at least partially peripheral container wall.

21. The sharpener according to claim 19, wherein at least one of said shaving-collecting container and said carrier plate are formed of transparent plastic.

22. The sharpener according to claim 19, wherein said carrier plate at least partially closes off said lower side of said sharpener housing.

23. The sharpener according to claim 19, wherein said core shaper has at least one supporting side projecting out of said carrier plate, a supporting surface running transversely to said at least one supporting side and integrally formed on said at least one supporting side, and a wedge-shaped shaving contour integrally formed on said supporting surface.

24. The sharpener according to claim 19, wherein said carrier plate has a peripheral side wall for form-lockingly positioning said carrier plate on said lower side of said sharpener housing.

25. The sharpener according to claim 19, wherein said shaving-collecting container has a peripheral side wall for form-lockingly positioning said shaving-collecting container on said upper side of said sharpener housing.

26. The sharpener according to claim 19, wherein said shaving-collecting container and said carrier plate form a double-shell integral housing for receiving said sharpener housing and torm-lockingly and releasably connecting said sharpener housing to at least one of said shaving-collecting container and said carrier plate, and said integral housing is retained on said sharpener housing by said carrier plate when said shaving-collecting container has been pivoted away.

27. The sharpener according to claim 19, wherein said having-collecting container and said carrier plate form a double-shell integral housing for receiving said sharpener housing and form-lockingly and releasably connecting said sharpener housing to at least one of said shaving-collecting container and said carrier plate, and said integral housing is retained by said shaving-collecting container when said carrier plate has been pivoted away.

28. The sharpener according to claim 19, wherein said core shaper is releasably connected to said carrier plate.

29. The sharpener according to claim 19, wherein said sharpener housing has:

a left side connected to said carrier plate; and an right side connected to said carrier plate.

30. The sharpener according to claim 19, wherein said carrier plate connects to said lower side of said sharpening housing.

31. The sharpener according to claim 30, wherein said carrier plate closes said lower side of said sharpening housing.

32. The sharpener according to claim 19, wherein said carrier plate connects to said upper side of said sharpening housing.

33. The sharpener according to claim 32, wherein said carrier plate closes said upper side of said sharpening housing.

34. The sharpener according to claim 19, wherein said carrier plate is pivotally retained on said sharpener housing.

35. The sharpener according to claim 34, wherein said core shaper projects out of said carrier plate, has a shaving rib, and has a rounded rear side directed away from said shaving rib to form a guide edge retaining said carrier plate in a clamping position when said core shaper is pivoted into said free space.

36. The sharpener according to claim 34, wherein said core shaper projects out of said carrier plate, has a shaving rib, and has a rounded rear side directed away from said shaving rib to form a guide edge retaining said carrier plate in a clamping position when said core shaper is pivoted into said free space, said core shaper has at least one supporting side projecting out of said carrier plate, a supporting surface running transversely to said at least one supporting side and integrally formed on said at least one supporting side, and a wedge-shaped shaving contour integrally formed on said supporting surface, and said guide edge is disposed on said at least one supporting side and extends over said supporting surface.

* * * * *